United States Patent [19]

Hattori et al.

[11] 4,413,471

[45] Nov. 8, 1983

[54] AIR-FUEL RATIO CONTROL APPARATUS OF AN INTERNAL COMBUSTION ENGINE

[75] Inventors: Kyo Hattori; Noriyoshi Shibata, both of Susono; Isamu Hagino, Aichi, all of Japan

[73] Assignee: Toyota Jidosha Kogyo Kabushiki Kaisha, Toyota, Japan

[21] Appl. No.: 326,653

[22] Filed: Dec. 2, 1981

[30] Foreign Application Priority Data

Dec. 3, 1980 [JP] Japan ..... 55-169654

[51] Int. Cl.[3] ..... F01N 3/08

[52] U.S. Cl. ..... 60/276; 123/440; 123/589

[58] Field of Search ..... 60/276, 289; 123/440, 123/489, 589

[56] References Cited

U.S. PATENT DOCUMENTS

| | | | |
|---|---|---|---|
| 3,782,347 | 1/1974 | Schmidt et al. | 60/276 |
| 3,990,411 | 11/1976 | Oberstadt et al. | 60/276 |
| 4,163,433 | 8/1979 | Fujishiro | 123/440 |
| 4,248,196 | 2/1981 | Toelle | 123/440 |
| 4,375,746 | 3/1983 | Hattori | 60/276 |

*Primary Examiner*—Charles J. Myhre
*Assistant Examiner*—Andrew M. Dolinar
*Attorney, Agent, or Firm*—Cushman, Darby & Cushman

[57] ABSTRACT

An air-fuel ratio control apparatus includes a specific integration means for integrating the rich or lean signal determined depending upon the detected concentration of the predetermined exhaust gas component, to produce an integration signal which is increased when the rich signal is applied and decreased only when the lean signal, having a duration longer than a predetermined period, is applied. If the short lean signal, having a duration shorter than or equal to the predetermined period, is produced, the above integration signal is utilized for adjusting the air-fuel ratio condition.

4 Claims, 7 Drawing Figures

AIR-FUEL RATIO CONTROL APPARATUS OF AN INTERNAL COMBUSTION ENGINE

The present invention relates to an air-fuel ratio control apparatus of an internal combustion engine.

A known air-fuel ratio control system has a concentration sensor for detecting the concentration of a particular component in exhaust gas, such as an oxygen concentration sensor (hereinafter referred to as $O_2$ sensor) for detecting the concentration of oxygen, and a three-way catalytic converter for removing HC, CO and $NO_x$ components contained in exhaust gas, that are installed in the exhaust system of an internal combustion engine. This control system controls the air-fuel ratio condition of the exhaust gas flowing into the catalytic converter, so that it approaches a stoichiometric air-fuel ratio, relying upon the output of the $O_2$ sensor. Among the air-fuel ratio control systems of this type, there is an air-fuel ratio control device, according to which a detection output from the $O_2$ sensor is compared with a predetermined reference value to prepare rich signals and lean signals of different levels depending upon the magnitude of comparison, whereby the direction of integration is determined depending upon the rich signals and lean signals, and the integration is effected by changing the integration time constant depending upon the rich signals and lean signals, thereby to adjust the air-fuel ratio relying upon the integrated output. For example, in a system in which the secondary air is supplied to the exhaust system at a place the upstream side of the three-way catalytic converter, if the amount of the secondary air is controlled by the detection output of the $O_2$ sensor, the air-fuel ratio condition of the exhaust gas is detected to lie more on the lean side than the true air-fuel ratio, due to the characteristics of the system and the $O_2$ sensor. Therefore, the integration time constant when lean signals are being produced must be reduced to be considerably smaller than the integration time constant when rich signals are being produced. When this condition is effected, the air control valve for controlling the amount of the secondary air is slowly opened but is quickly closed, causing the air-fuel ratio condition of the exhaust gas flowing into the catalytic converter to approach the stoichiometric air-fuel ratio.

In the above-mentioned air-fuel ratio control system, however, false lean signals are temporarily produced by some cause during a time where rich signals should be produced. For example, if the air-fuel ratio of the mixture in the intake system becomes temporarily lean, due to nonuniform distribution among the cylinders, the lean air-fuel ratio is detected by the $O_2$ sensor. Consequently, the $O_2$ sensor temporarily produces lean signals (hereinafter referred to as lean spike). When the lean spike is produced, the output of integration temporarily assumes a small value or becomes zero, since the integration time constant is small while lean signals are produced. Consequently, the amount of feeding the secondary air becomes smaller than a requested value, and the air-fuel ratio condition of the exhaust gas flowing to the catalytic converter is controlled toward a side more rich than the stoichiometric air-fuel ratio.

In order to solve the above-mentioned problem, a method has been proposed to delay the response time of the whole system, so that the system will not respond to instantaneous variations, such as the generation of lean spikes. According to this method, however, response characteristics are delayed with respect to not only the lean spikes, but also to the normal variation of the air-fuel ratio caused by the air-fuel ratio feedback control.

SUMMARY OF THE INVENTION

It is, therefore, an object of the present invention to provide an air-fuel ratio control apparatus which can precisely control the air-fuel ratio condition, even when false signals with respect to the air-fuel ratio, such as lean spikes, are produced from the $O_2$ sensor.

According to the present invention, an air-fuel ratio control apparatus comprises: means for detecting the concentration of a predetermined component in the exhaust gas and to generate an electrical signal which indicates the detected concentration; means for comparing the level of the generated electrical signal with a predetermined reference level to produce a discrimination signal having a first or second level which is different from each other; first integration means for integrating, with respect to time, the discrimination signal to produce a first integration signal which is increased during the first level period of the discrimination signal and decreased during the second level period of the discrimination signal; second integration means for integrating, with respect to time, the discrimination signal to produce a second integration signal which is increased during the first level period of the discrimination signal and decreased during the second level period except for a predetermined period just after the first level period of the discrimination signal; means for selecting the first integration signal or the second integration signal in response to the discrimination signal; and means for adjusting the air-fuel ratio condition of the engine in response to the selected integration signal of the selection means.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
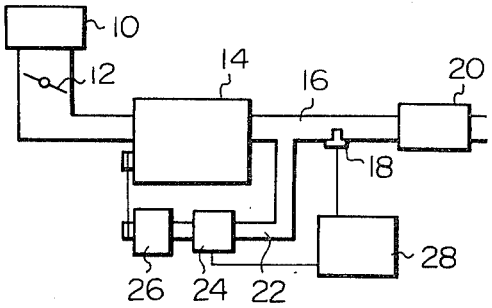
FIG. 1 is a schematic view illustrating an embodiment of the present invention.

FIG. 1 schematically illustrates an embodiment of the present invention, in which reference numeral 10 denotes a carburetor, 12 denotes a throttle valve, 14 denotes an engine body, 16 denotes an exhaust passage, 18 and 20 denote an $O_2$ sensor and a three-way catalytic converter, respectively, that are provided in the exhaust passage 16, 22 denotes a secondary air passage for feeding the secondary air to a portion located on the upstream side of the $O_2$ sensor 18 and the catalytic converter 20 in the exhaust passage 16, 24 denotes a secondary air control valve provided on the passage 22, 26 denotes an air pump, and 28 denotes a control circuit which produces drive signals to adjust the secondary air control valve 24 responsive to the detection output of the $O_2$ sensor 18. According to the air-fuel ratio control system of the embodiment of the present invention, a mixture of gas which is more on the rich side than the stoichiometric air-fuel ratio is produced by the carburetor 10, and the secondary air is supplied in suitable amounts into the exhaust system depending upon the detection output of the $O_2$ sensor 18, such that the air-fuel ratio condition of the exhaust gas flowing into the catalytic converter 20 approaches the stoichiometric air-fuel ratio.

Figure 2:
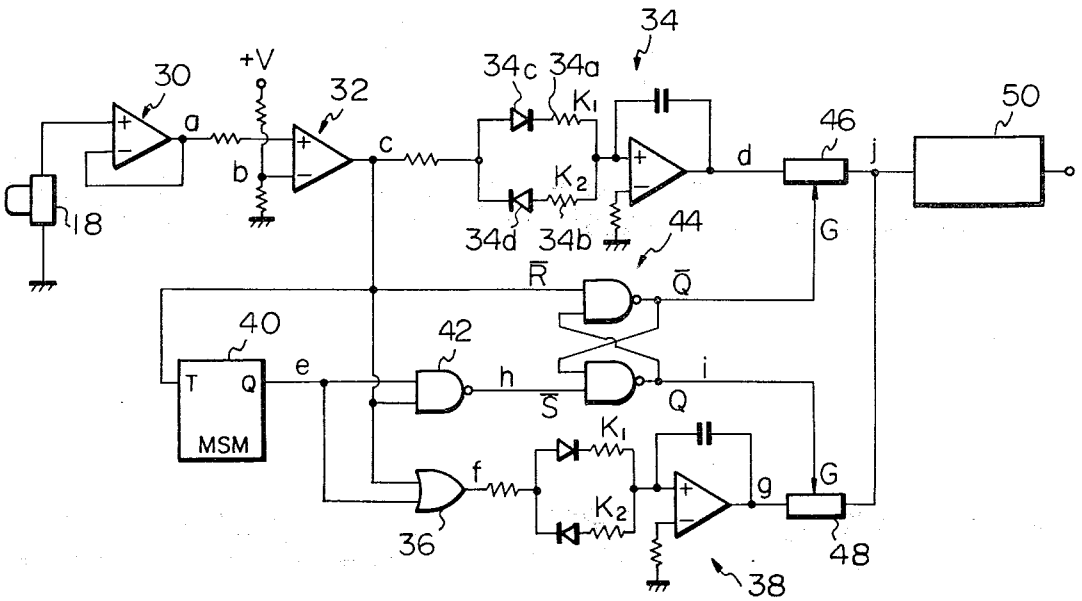
FIG. 2 is a block diagram illustrating one example of the control circuit in FIG. 1.
Figure 3:
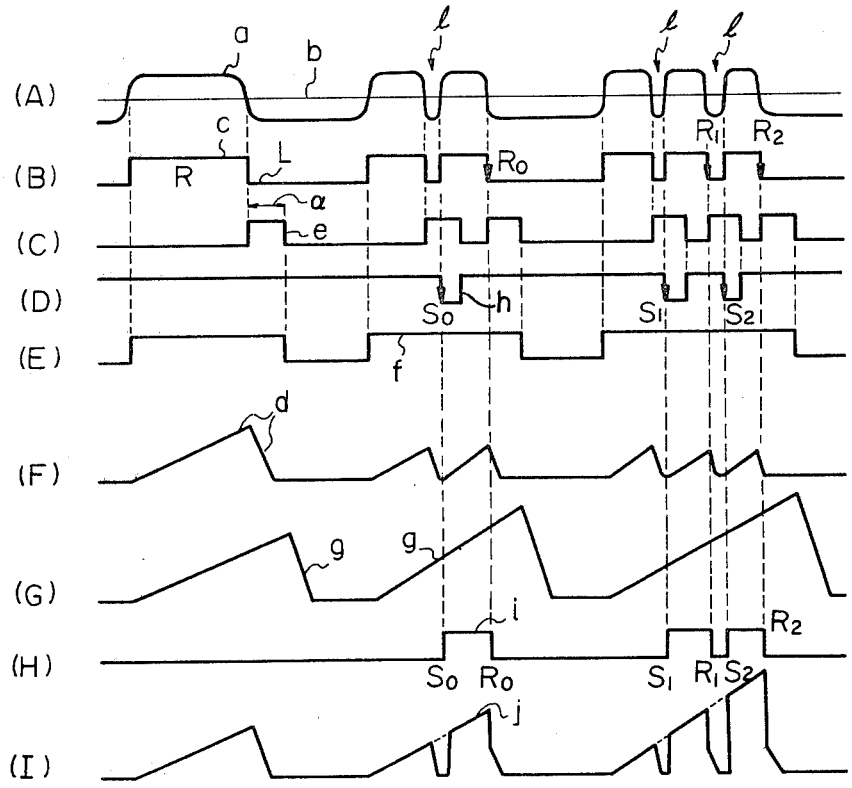
FIG. 3 contains wave forms of signals obtained at various positions in the control circuit of FIG. 2.

FIG. 2 is a block diagram illustrating an example of the control circuit 28 of FIG. 1, and FIG. 3 is a diagram showing waveforms of signals obtained at each portion in the control circuit of FIG. 2. In the circuit of FIG. 2, the detection output of the $O_2$ sensor 18 is applied to a comparator 32 via a voltage follower 30, and is compared with the reference voltage. Symbol a in FIG. 3(A) represents the detection output of the $O_2$ sensor 18, and b denotes the reference voltage set by the comparator 32. As is well known, when an excess of oxygen is present in the exhaust gas, i.e., when the air-fuel ratio condition is on the lean side of the stoichiometric air-fuel ratio, the $O_2$ sensor 18 produces a voltage of the low level. When oxygen is not present in large amounts, i.e., when the air-fuel ratio condition is on the rich side of the stoichiometric air-fuel ratio, the $O_2$ sensor 18 produces a voltage of the high level. As represented by c of FIG. 3(B), therefore, the comparator 32 produces a rich signal R of the high level when the air-fuel ratio condition of the exhaust gas is rich and produces a lean signal L of the low level when the air-fuel ratio condition of the exhaust gas is lean.

The output c of the comparator 32 (discrimination signal) is fed to the input terminal of a first integrator 34, fed to the input terminal of a second integrator 38 via an OR gate 36, fed to the trigger terminal of a monostable multivibrator 40, fed to a NAND gate 42, and fed to the reset input terminal of an S-R flip-flop 44.

The first integrator 34 is constructed so that the integration time constant differs depending upon the direction of integration. Namely, the input circuit of the integrator 34 consists of arms connected in parallel with each other, the arms being made up of resistors 34*a*, 34*b* having different resistances $K_1$, $K_2$, and diodes 34*c*, 34*d*, that are connected in series, respectively. Here, the diodes 34*c* and 34*d* have been connected in opposite directions relative to each other. Therefore, when the output c of the comparator 32 is a rich signal, the integration is effected with an integration time constant related to the resistor 34*a* having a resistance of $K_1$. When the output c of the comparator 32 is a lean signal, the integration is effected with an integration time constant related to the resistor 34*b* having a resistance of $K_2$. Here, however, the resistance $K_2$ has been selected to be greater than the resistance $K_2$. Symbol d of FIG. 3(F) represents the output of the first integrator 34.

The monostable multivibrator 40 has been constructed so that it is triggered by the negative edge of the output c of the comparator 32. When triggered, the monostable multivibrator 40 generates pulses e having a predetermined pulse width $\alpha$ as show in FIG. 3(C). The pulses e are applied to the NAND gate 42 and to the OR gate 36.

As mentioned above, the OR gate 36 is served with the output c of the comparator 32 and the output e of the monostable multivibrator 40. Therefore, the OR gate 36 produces an output f as shown in FIG. 3(E) which will be integrated by the second integrator 38. The second integrator 38 is constructed quite in the same manner as the first integrator 34, and has the same circuit constant. Accordingly, the second integrator 38 produces an output g as shown in FIG. 3(G).

The outputs of the first integrator 34 and the second integrator 38 are applied to a drive circuit 50 via gate circuits 46 and 48 which will be opened and closed by the outputs $\overline{Q}$ and Q of the flip-flop 44. Namely, when the flip-flop 44 is being set, the gate circuit 48 is opened and the gate circuit 46 is closed. When the flip-flop 44 is being reset, the gate circuit 48 is closed and the gate circuit 46 is opened.

The flip-flop 44 is set by the negative edge of the output of the NAND gate 42, and is reset by the negative edge of the output c of the comparator 32. The NAND gate 42 is served with the output c of the comparator 32 and the output e of the monostable multivibrator 40, as mentioned above, and hence produces an output h as shown in FIG. 3(D). As shown in FIGS. 3(B) and 3(D), therefore, the flip-flop 44 is set at moments $S_O$, $S_1$ and $S_2$, and is reset at moments $R_O$, $R_1$ and $R_2$. Accordingly, the flip-flop 44 produces the output Q as indicated by i in FIG. 3(H). Hence, the output g of the second integrator 38 is applied to the drive circuit 50 only when the Q output i of the flip-flop 44 assumes the high level; in other cases, the output d of the first integrator 34 is applied to the drive circuit 50. As a result, the input j of the drive circuit 50 as shown in FIG. 3(I) is converted into a drive signal in the drive circuit 50, and the secondary air control valve 24 (FIG. 1) is controlled. In other words, the secondary air control valve 24 is controlled so that the amount of the secondary air supplied to the engine varies nearly in proportion to the input j.

Functions and effects of the embodiment of the invention will be described below. The monostable multivibrator 40 generates pulses e which assume the high level only for a predetermined period of time $\alpha$ from the moment at which the output of the comparator 32 is inverted from the rich signal to the lean signal. When the rich signal is produced again while the pulse e assumes the high level, the flip-flop 44 is set, and the output g of the second integrator 38 is fed to the drive circuit 50, instead of the output d of the first integrator 34. When the rich signal is produced again while the output of the monostable multivibrator 40 is assuming the high level, the second integrator 38 does not change the direction of integration, but remains in the direction of increase. Therefore, when a lean signal, i.e., lean spike (refer to l of FIG. 3(A)) is developed having a width narrower than the pulse width $\alpha$ of the output pulse e determined by the time constant of the monostable multivibrator 40, the output of the second integrator 38 that will not return to zero is fed to the drive circuit 50 at a moment when the lean spike l is generated. According to the embodiment of the present invention, therefore, the effects of the lean spike can be removed almost completely.

Figure 4:
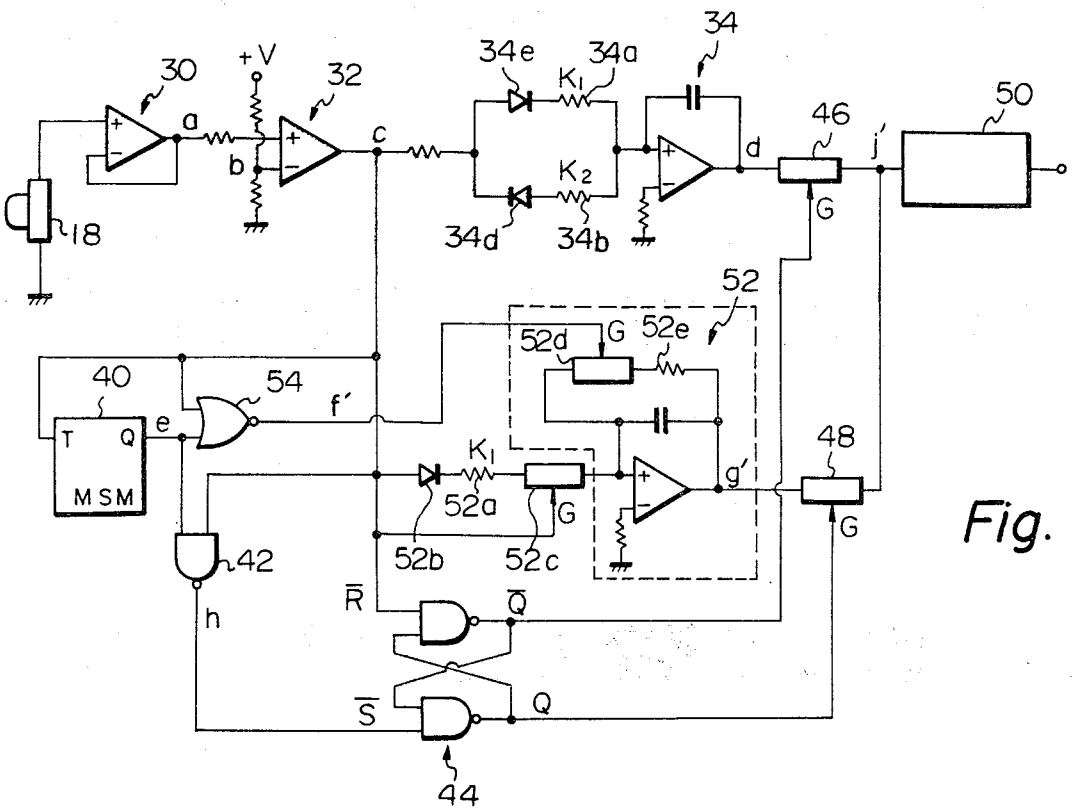
FIG. 4 is a block diagram illustrating another example of the control circuit in FIG. 1.
Figure 5:
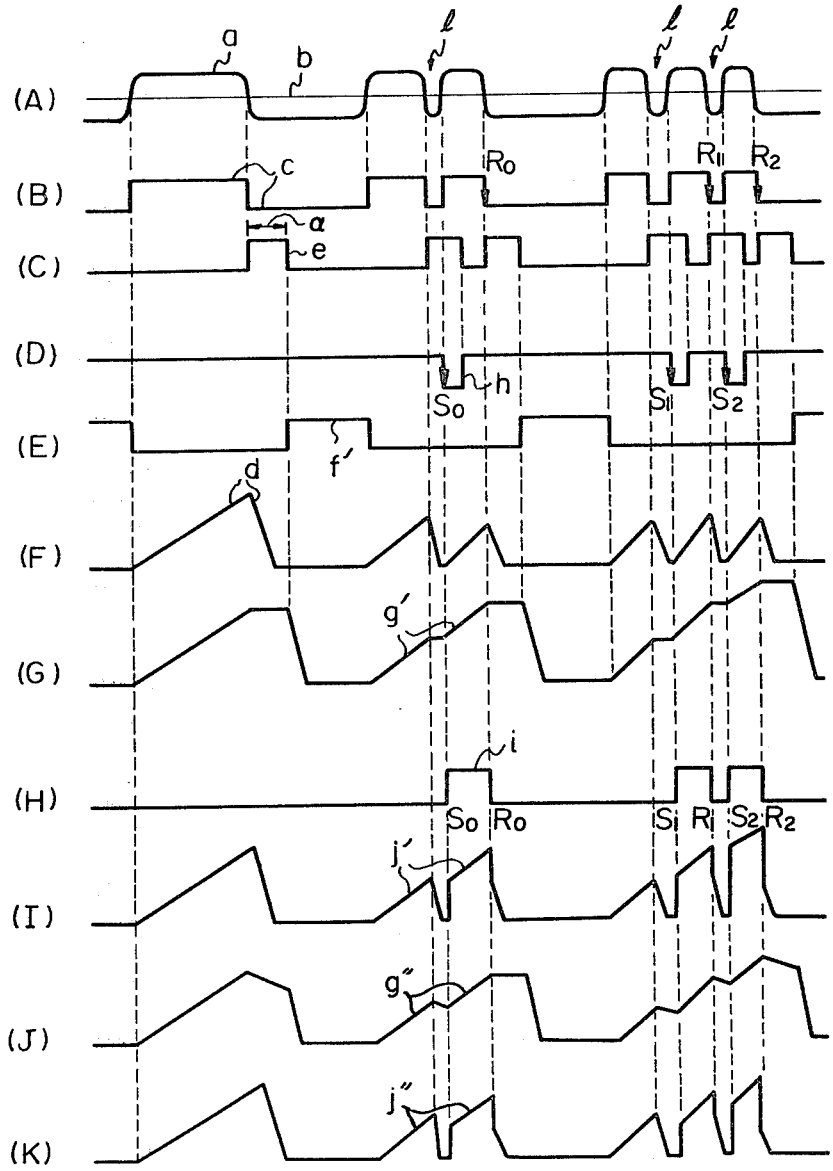
FIG. 5 contains wave forms of signals obtained at various positions in the control circuits of FIGS. 2 and 6.

FIG. 4 is a block diagram of another embodiment of the control circuit 28 of FIG. 1, and FIG. 5 is a diagram showing the waveforms of signals obtained at each of the portions in the circuit of FIG. 4. The embodiment of FIG. 4 is constructed nearly in the same manner as the embodiment of FIG. 2, except that the second integrator and peripheral portions thereof are formed in a different way. In FIGS. 4 and 5, therefore, the same constituent elements and the waveforms are denoted by the same reference numerals. In the embodiment of FIG. 4, the input circuit of the second integrator 52 consists of a resistor 52*a* having a resistance of $K_1$, a diode 52*b* connected in the forward direction, and a gate circuit 52*c* all three of which are connected in series. Further, a series circuit, consisting of a gate circuit 52*d* and a resistor 52*e*, is connected across both terminals of the integration capacitor. The gate circuit 52*c* is opened and closed by the output c of the comparator 32. Namely, the gate circuit 52*c* is opened only when the output c of the comparator 32 assumes the high level (only when the rich signal is produced), so that the input is fed to the second integrator 52. When the lean signal is produced, the gate circuit 52*c* is closed, and the input is not fed. The gate circuit 52*d*, on the other hand, is opened and closed by the output of the NOR gate 54 which is served with the output c (refer to FIG. 5(B)) of the comparator 32 and the output e (refer to FIG. 5(C)) of the monostable multivibrator 40. Therefore, the NOR gate 54 produces an output f' as shown in FIG. 5(E). That is, if the duration of the lean signal is longer than a period in which the output pulse e of the monostable multivibrator 40 assumes the high level, the output f' of the NOR gate 54 becomes the high level. The high level period of the output f' corresponds to the difference between the duration of the lean signal and the high level period of the output pulse e. Accordingly, during this period corresponding to the difference, the gate circuit 52*d* is opened, and the electric charge stored in the integration capacitor is discharged via the resistor 52*e*. When the output of the comparator 32 is a rich signal, therefore, the second integrator 52 performs the integrating operation in a customary manner. When the output of the comparator 32 is a lean signal, the input is not supplied to the second integrator 52; i.e., the integrator 52 ceases the integration operation and holds a value attained just before the integration operation ceases. The value becomes zero when the duration of the lean signal becomes longer than the period $\alpha$ in which the output pulse of the monostable multivibrator 40 assumes the high level. When the lean spike l is generated, therefore, the output g' of the second integrator 52 assumes such a waveform that holds the integrated value when the rich signal is being produced just before the lean spike l is generated, as shown in FIG. 5(G). Whether the output of the first integrator 34 or the output of the second integrator 52 should be fed to the drive circuit 50, is determined quite in the same manner as in the embodiment of FIG. 2. According to this embodiment, therefore, the signal which is finally fed to the drive circuit 50 becomes as represented by j' in FIG. 5(I).

Figure 6:
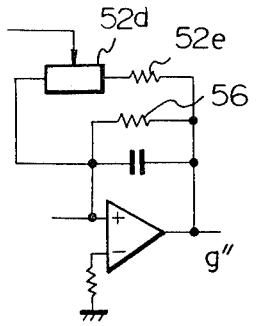
FIG. 6 is a block diagram illustrating a part of another example of the control circuit in FIG. 1.

According to a further embodiment, a portion of the control circuit 28 surrounded by a broken line in FIG. 4 is constructed as shown in FIG. 6. Namely, according to this embodiment, a resistor 56 is connected in parallel with the integration capacitor of the second integrator 52 of the embodiment of FIG. 4. In the prior embodiment of FIG. 4, the integrated value when the rich signal is being produced just before the lean spike l is generated, is held for the lean spike l. According to this embodiment, on the other hand, the integrated value gradually decreases, even when the lean spike l is being generated, since the electric charge stored in the integration capacitor is gradually discharged via the resistor 56. FIG. 5(J) illustrates the output g'' of the second integrator according to this embodiment. In this embodiment, therefore, the signal which is finally supplied to the drive circuit becomes that as represented by j'' of FIG. 5(K).

Figure 7:
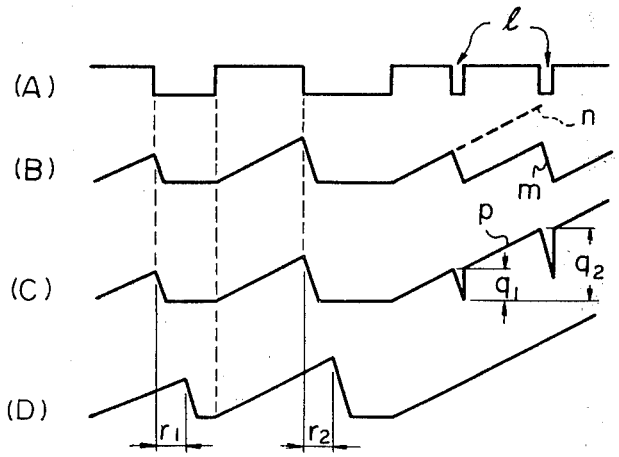
FIG. 7 contains wave forms used for explaining the effect of the present invention.

FIG. 7 is a diagram illustrating the effects of the present invention in comparison with the effects of the conventional art. In the following description, however, the present invention is represented by the embodiment of FIG. 4 for the purpose of convenience. FIG. 7(A) illustrates the output of the comparator. When lean spikes l are generated in the output as shown in FIG. 7(A), the simple integration of the output of the comparator in an unbalanced manner results in that the final output m applied to the drive circuit becomes zero upon each application of the lean spike l, as shown in FIG. 7(B); i.e., the output characteristics greatly differ from the desired output n that is indicated by a broken line. According to the present invention, on the other hand, even when lean spikes l are generated, the output p after the lean spike is generated increases starting from a value $q_1$ or $q_2$ just before the lean spike is generated and, hence, the output is obtained nearly as desired, as indicated in FIG. 7(C). FIG. 7(D) illustrates output characteristics for the drive circuit according to the conventional art, in which are smoothing circuit, such as low-pass filter or a delay circuit, is formed in the control circuit to remove lean spikes. According to this method, however, the response is delayed when the rich signal is converted into the lean signal, as indicated by $r_1$ and $r_2$, although lean spikes are removed. According to the present invention, however, the delay of response of this type does not take place, as shown in FIG. 7(C).

According to the present invention as illustrated in detail in the foregoing, it is possible to reliably prevent the air-fuel control precision from being deteriorated by false signals of the air-fuel ratio, such as lean spikes, without deteriorating other response characteristics.

Although the above-mentioned embodiments have dealt with the air-fuel control system in which the secondary air is supplied to the exhaust system, the present invention can be applied to any air-fuel control system in the same manner as the above-mentioned embodiments, if the integration time constant is changed depending upon the rich signals and lean signals, to obtain quite the same effects.

As many widely different embodiments of the present invention may be constructed without departing from the spirit and scope of the present invention, it should be understood that the present invention is not limited to the specific embodiments described in this specification, except as defined in the appended claims.

We claim:

1. An air-fuel ratio control apparatus of an internal combustion engine comprising:

means for detecting the concentration of a predetermined component in the exhaust gas to generate an electrical signal which indicates the detected concentration;

means for comparing the level of said generated electrical signal with a predetermined reference level to produce a discrimination signal having a first or second level which is different from each other;

first integration means for integrating, with respect to time, said discrimination signal to produce a first integration signal which is increased during the first level period of said discrimination signal and decreased during the second level period of said discrimination signal, the integration time constant for increasing the integration signal being larger than the integration time constant for decreasing the integration signal;

second integration means for integrating, with respect to time, said discrimination signal to produce a second integration signal which is increased during the first level period of said discrimination signal and decreased during the second level period at least after a predetermined period just after the first level period of said discrimination signal, the integration time constant for increasing the integration signal being larger than the integration time constant for decreasing the integration signal;

means for selecting said first integration signal or said second integration signal in response to said discrimination signal; and means for adjusting the air-fuel ratio condition of the engine is response to said selected integration signal of said selection means.

2. An air-fuel ratio control apparatus as claimed in claim 1, wherein said second integration means comprises an integration circuit for integrating, with respect to time, said discrimination signal to produce a second integration signal which is increased during the first level period of said discrimination signal and during said predetermined period after the first level period of said discrimination signal, and decreased during the second level period except for said predetermined period just after said first level period.

3. An air-fuel ratio control apparatus as claimed in claim 1, wherein said second integration means comprises an integration circuit for integrating, with respect to time, said discrimination signal to produce a second integration signal which is increased during the first level period of said discrimination signal, and decreased during the second level period except for said predetermined period just after said first level period, said second integration signal being maintained at an increased level during said predetermined period just after said first level period.

4. An air-fuel ratio control apparatus as claimed in claim 1, wherein said second integration means comprises an integration circuit for integrating, with respect to time, said discrimination signal to produce a second integration signal which is increased during the first level period of said discrimination signal, and decreased during the second level period of said discrimination signal, the decreasing speed of the second integration signal during said predetermined period just after said first level period being extremely lower than the decreasing speed of the second integration signal during the remaining period of the second level period.

* * * * *